US007182030B2

(12) United States Patent
Privette

(10) Patent No.: US 7,182,030 B2
(45) Date of Patent: Feb. 27, 2007

(54) KAYAK LAUNCHER

(76) Inventor: Henry A. Privette, P.O. Box 885, Oriental, NC (US) 28571

( * ) Notice: Subject to any disclaimer, the term of this patent is extended or adjusted under 35 U.S.C. 154(b) by 0 days.

(21) Appl. No.: 11/254,534

(22) Filed: Oct. 20, 2005

(65) Prior Publication Data

US 2006/0090687 A1 May 4, 2006

Related U.S. Application Data

(60) Provisional application No. 60/625,470, filed on Nov. 4, 2004.

(51) Int. Cl.
*B63C 7/00* (2006.01)

(52) U.S. Cl. ..... 114/44; 405/3

(58) Field of Classification Search ..... 114/44, 114/45, 46, 47, 48, 263, 362; 405/1, 3, 4, 405/7

See application file for complete search history.

(56) References Cited

U.S. PATENT DOCUMENTS

| | | | | |
|---|---|---|---|---|
| 515,878 A | | 3/1894 | Hadley et al. | |
| 1,486,257 A | | 3/1924 | Muller | |
| 3,412,702 A | | 11/1968 | Mann | |
| 3,448,712 A | * | 6/1969 | Adams, Jr. et al. | 114/44 |
| 4,018,179 A | | 4/1977 | Rutter | |
| 4,072,119 A | | 2/1978 | Williams | |
| 4,732,102 A | | 3/1988 | Holman et al. | |
| 5,002,000 A | | 3/1991 | Rutter | |
| 5,131,342 A | | 7/1992 | Sackett | |
| 5,267,811 A | * | 12/1993 | Evans | 405/1 |
| 5,425,322 A | * | 6/1995 | Ziober | 114/44 |
| 5,860,379 A | | 1/1999 | Moody | |
| 6,032,601 A | | 3/2000 | Gates | |
| 6,131,528 A | * | 10/2000 | Meek et al. | 114/44 |
| 6,263,820 B1 | * | 7/2001 | Crifase et al. | 405/1 |
| 6,477,968 B2 | * | 11/2002 | Powell | 114/46 |

* cited by examiner

*Primary Examiner*—Lars A. Olson
(74) *Attorney, Agent, or Firm*—MacCord Mason PLLC

(57) ABSTRACT

An apparatus is described for use in stabilizing a watercraft such as a kayak or canoe during boarding and exiting the watercraft. The apparatus includes a pair of spaced pontoons having above-water surface areas, below-water surface areas, inner sides, and lengths equal to from about 0.25 to about 1.0 times the length of the watercraft. The pontoons are joined in a spaced, parallel relationship by horizontal supports having lengths approximately equal to the width of the watercraft. The supports are transverse to the longitudinal axes of the pontoons and having opposed outer ends attached to the pontoons, e.g., to the below-water areas of the pontoons, whereby the supports are below water level when the apparatus is resting on the surface of the water. The apparatus preferably also includes rollers or support saddles mounted on the supports to facilitate movement of the watercraft onto and off of the apparatus.

19 Claims, 3 Drawing Sheets

KAYAK LAUNCHER

The application claims the benefit of the filing date of Provisional Application Ser. No. 60/625,470, filed Nov. 4, 2004.

BACKGROUND OF THE INVENTION (1) Field of the Invention

The present invention relates generally to an apparatus for stabilizing a kayak, canoe or other small watercraft during boarding or exiting, and for transportation of gear/supplies by towing behind another personal watercraft, or for storing the watercraft supported above the water.

(2) Description of the Prior Art

A significant concern among users and potential users of kayaks, canoes and other small watercraft is that the watercraft is unstable and will capsize when the user is boarding or exiting the watercraft. This concern is realistic where the watercraft is being boarded from a dock, pier, bulkhead, or other area where maintenance of the user's center of gravity over the center of the watercraft is difficult.

SUMMARY OF THE INVENTION

The present invention relates to a simple-to-use apparatus that addresses this concern by stabilizing the watercraft so that it will not tip over or capsize, even when the user's center of gravity is substantially displaced. The present apparatus may be used in both boarding and in exiting, and towing behind the watercraft. While use of the apparatus will be described herein in terms of use with a kayak, it will be understood that the apparatus can also be used to stabilize canoes and other small watercraft that tend to tip during entry or exit.

Generally, the present launcher is comprised of a pair of parallel, spaced pontoons joined by supports, preferably at a distance approximately equal to the width of the kayak to be stabilized. The term, "pontoons" is used in its broadest sense to connote an elongated rigid or inflatable, buoyant element that may have, for example, a hollow, cellular or foam interior, so that the overall density of the pontoon is less than water. The pontoons are preferably up to about the length of the kayak, and preferably from about one-fourth to about one-half the length of the kayak. The pontoons are held in spaced, parallel relationship by a pair of spaced, transverse supports or supports having opposed ends, with the pontoons being attached or secured to the ends of the transverse supports.

The ends of the supports are attached or secured to the pontoons so that the supports are at or beneath the surface of the water when the launcher is resting in the water and supporting a user-occupied watercraft. Preferably, the supports are attached to the below-water area of the pontoons. That is, each pontoon, when resting on the water, will have a below-water area and an above-water area, with the support ends being attached at the same level to the below-water area of each pontoon, so that the supports are parallel and at or below the water surface. Alternatively, the supports can include upwardly extending ends attachable to the above-water areas of the pontoons, so long as the supports are at or below water.

The spacers preferably include rollers to facilitate movement of the kayak onto and off of the launcher. In the simplest embodiment of the invention, these rollers are in the form of tubular sleeves around the spacer supports, with the supports having a circular cross-section, and the tubular sleeves having an inner circular diameter slightly greater than the cross-sectional diameter of the supports, thereby permitting the sleeves to rotate around the supports. The sleeves preferably have a frictional surface so that the friction between the kayak and the sleeves causes the sleeves to rotate when the kayak is moved over the sleeves onto or off of the launcher, thereby lessening resistance to movement of the kayak.

In another embodiment of the invention, designed for use primarily with heavier watercraft, the launcher includes saddles generally conforming to the shape of the hull of the craft to support the kayak, and rollers adjacent one end of a saddle to facilitate entry and launch of the kayak. Preferably, the saddles are mounted onto each of the spacer supports, with each saddle having a generally horizontal center section and upwardly inclined side wings on either side of the center section. Spaced rollers are positioned along the forward edge of the front saddle. Preferably, the rollers are spaced at a distance approximately equal to the length of the saddle center section, and are mounted on axles that are upwardly inclined at the same angle as the saddle wings, so that the left and right rollers are in planes with the left and right wings, respectively.

The launcher may include various optional features, such as carrying handles on the pontoons, detachable straps extending across the tops of the pontoons from one pontoon to the other to secure the kayak to the launcher, and a line to secure the launcher to the dock, and wheels on either side of the launcher to facilitate movement of the launcher on land. The upper surfaces of the pontoons may be skinned with non-skid surfaces so that the pontoons can be used as steps in boarding or exiting the kayak. A handrail may extend upwardly from the launcher for the user to hold onto during boarding and exiting.

In use, the launcher is positioned adjacent the dock or other location from which the user will board the kayak, and the kayak is moved into position between the pontoons. Optionally, but not necessarily, the kayak can be secured to the launcher with the detachable straps. When the user boards the kayak, either by initially stepping into the kayak, or first onto the pontoon closest to the dock and then into the kayak, the pontoons prevent tipping of the kayak, and the proximity of the pontoons to the sides of the kayak prevent the kayak from shifting relative to the launcher.

Once seated, it is possible for the user to simply push away from the launcher due to the positioning of the kayak supported at or near the water level, resulting from the additional weight of the user which lowers the launcher so that the supports are below the water and such that the kayak floats on the water and will easily slide off of the launcher. When desiring to return to the dock, the user paddles or pushes the kayak back onto the launcher between the pontoons and climbs back onto the dock. It is important to note that the above outlined maneuvers can be done without aid from a second person. Also, the launcher can easily be assembled and disassembled for portability to or from a launch site, or for convenient storage.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
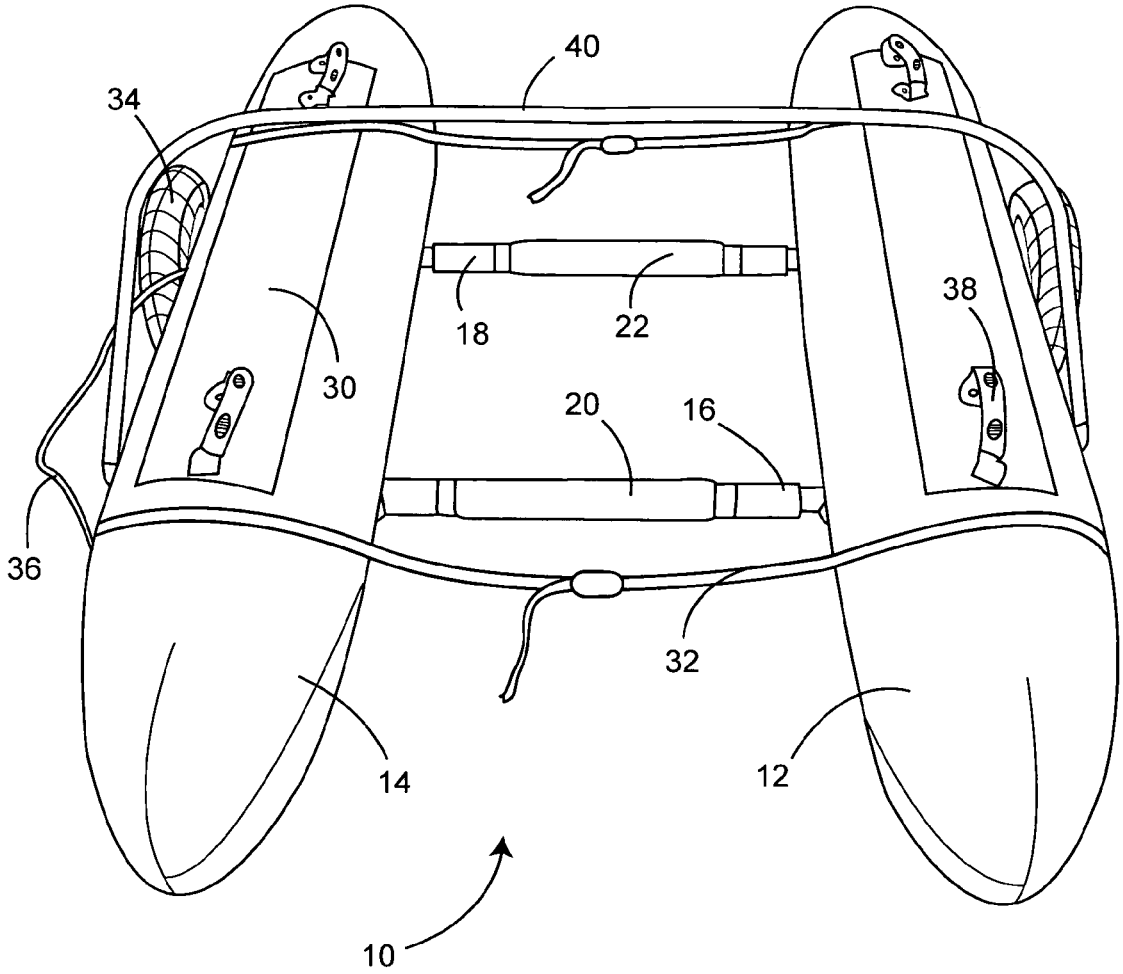
FIG. 1 is a perspective view of a first embodiment of the invention as seen from the front.

As best illustrated in FIG. 1, launcher, generally 10, is comprised of left and right pontoons 12 and 14, respectively, which are connected by spacer supports 16 and 18 which position pontoons 12 and 14 at a distance approximately equal to the width of the typical kayak with which launcher 10 is to be used. Supports 16 and 18 are covered with tubular sleeves 20 and 22, respectively, sized for rotation about supports 16 and 18 under the frictional forces of a kayak moving over the sleeves, thereby facilitating launching and docking of the kayak from and onto launcher 10.

Launcher 10 may also include non-skid step surfaces 30 on the tops of pontoons 12 and 14, straps 32 to secure the kayak between pontoons 12 and 14, wheels 34 on either side of launcher 10 to enable a user to pull launcher 10 on land, line 36 to secure launcher 10 to a dock or other boarding area, and carrying handles 38 on pontoons 12 and 14. Handrail 40 is spaced above and transverse to pontoons 12 and 14 to further assist the user in boarding or exiting the kayak. The handrail can also be mounted at other orientations.

Figure 2:
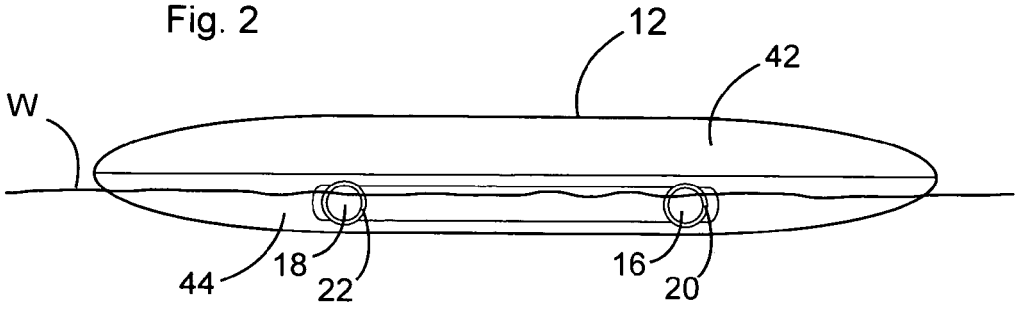
FIG. 2 is a sectional side view of a kayak launcher in the water showing the inner side of one of the pontoons and the position of the supports.
Figure 3:
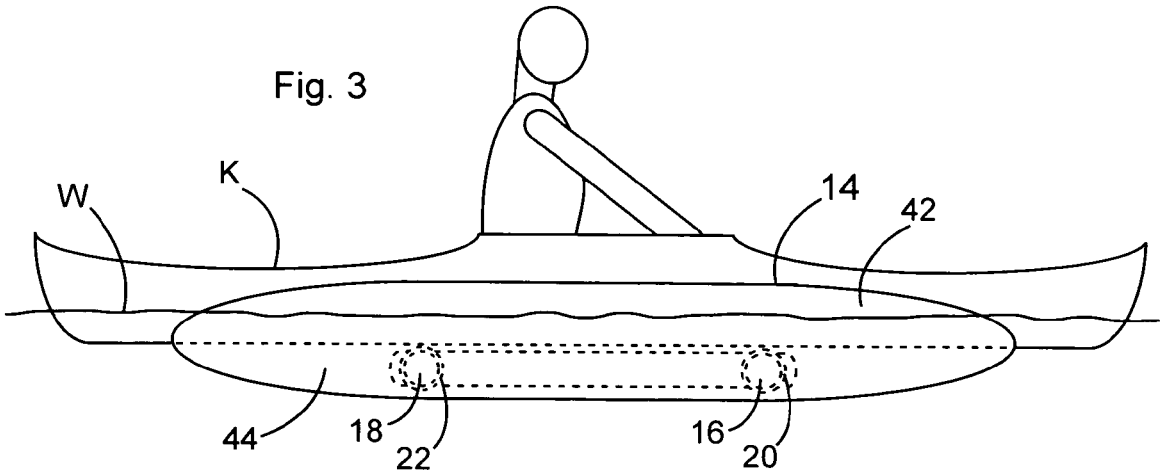
FIG. 3 is a side view of a kayak launcher in the water supporting a user-occupied kayak.

As illustrated in FIGS. 2 and 3, pontoons 12 and 14 each include an above-water surface area 42 and a below-water area 44. The relative sizes of above-water area 42 and below-water area 44 will vary depending upon whether or not launcher 10 is supporting a user-occupied kayak K. In order to facilitate loading and unloading of kayak K from launcher 10, it is preferred that supports 16 and 18 are attached to pontoons 12 and 14 so that supports 16 and 18 are below the water level when launcher 10 is in the water. As shown, supports 16 and 18 are attached to the inner sides of pontoons 12 and 14 along the below-water area 44.

Figure 4:
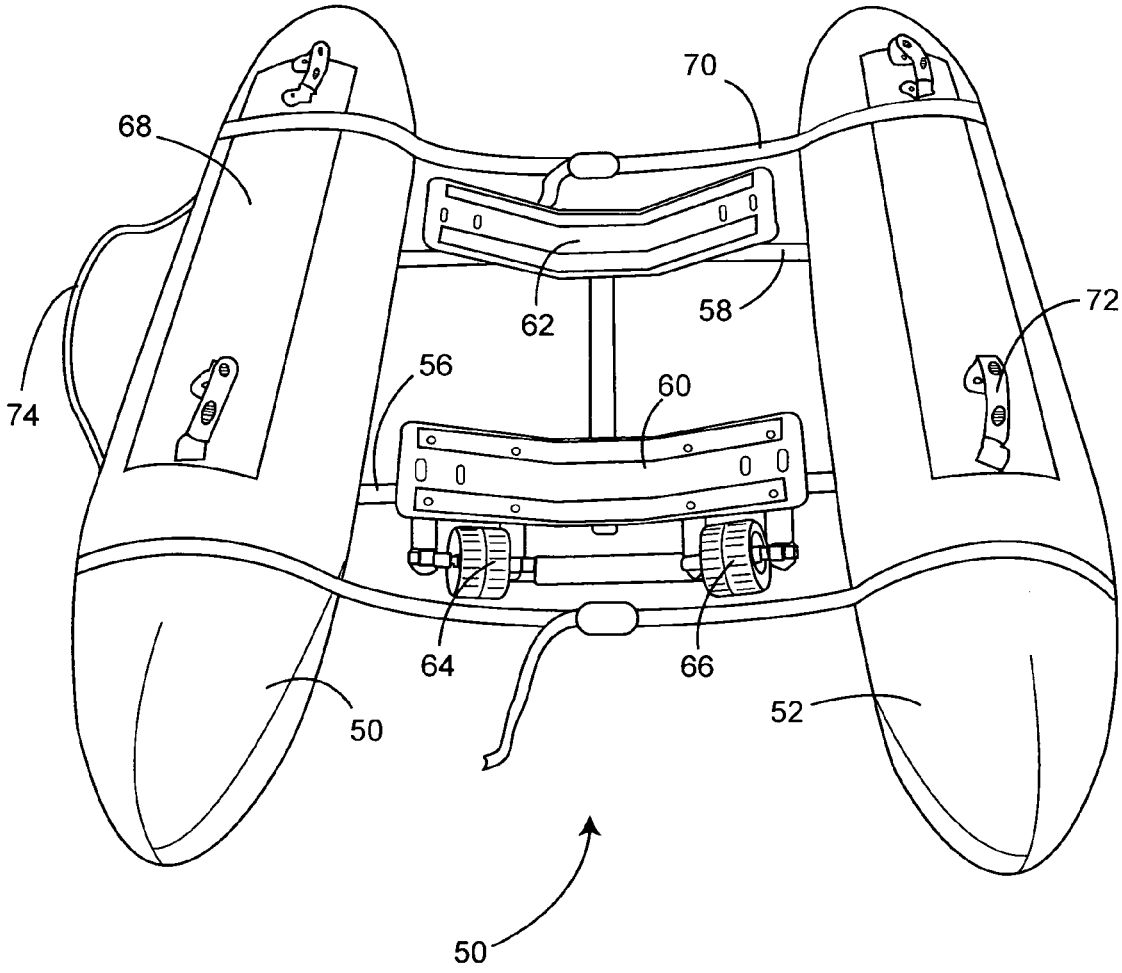
FIG. 4 is a perspective view of a second embodiment of the invention as seen from the front.

FIG. 4 illustrates an embodiment of the invention designed to support and launch heavier kayaks and other watercraft. The embodiment of FIG. 4 is used in the same manner as the embodiment illustrated in FIG. 1. In this embodiment, launcher, generally 50, is comprised of spaced pontoons 52 and 54 held in position by spacer supports 56 and 58. However, instead of tubular sleeves 20 and 22, movement of the kayak onto and off of launcher 50, and support of the kayak on launcher 50, is aided by front and rear saddles 60 and 62, each having a generally horizontal center section and raised side wings. Inclined rollers 64 and 66 are positioned in front of the forward edge of the side wings of saddle 60. Launcher 50 may also include non-skid surfaces 68, detachable straps 70, carrying handles 72, and docking line 74, as well as wheels and handrails similar to those illustrated in FIG. 1.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. An apparatus having a given width and given length for stabilizing a watercraft during boarding and exiting of said watercraft comprising:

a) a pair of spaced pontoons having above-water surface areas, below-water surface areas, and inner sides;

b) watercraft supports joining said pontoons, said supports being below the water level when said apparatus is in the water; and c) rollers carried on said supports.

2. The apparatus of claim 1, wherein said pontoons are rigid pontoons.

3. The apparatus of claim 1, wherein the inner sides of said pontoons are attached at a distance approximately equal to the given width of said watercraft.

4. The apparatus of claim 1, wherein said pontoons have a length that is from 0.25 to 1.0 times the length of the given length of said watercraft.

5. The apparatus of claim 1, further including watercraft support saddles on said supports.

6. An apparatus having a given width and given length for stabilizing a watercraft during boarding and exiting of said watercraft comprising:

a) a pair of spaced pontoons having above-water surface areas, below-water surface areas, and inner sides;

b) horizontal supports joining said pontoons in a spaced, parallel relationship, said supports being transverse to the longitudinal axes of said pontoons and having opposed outer ends attached to said pontoons, whereby said supports are below the water level when said apparatus is in the water; and c) watercraft supporting rollers mounted on said supports, said rollers being in the form of sleeves rotatable on said supports.

7. The apparatus of claim 6, wherein the above-water surface area of each pontoon is approximately equal to the below-water surface of the pontoon.

8. The apparatus of claim 6, wherein the inner sides of said pontoons are attached at a distance approximately equal to the given width of said watercraft.

9. The apparatus of claim 6, wherein said pontoons have a length that is from 0.25 to 0.5 times the length of the given length of said watercraft.

10. The apparatus of claim 6, wherein said watercraft is a kayak or a canoe.

11. An apparatus having a given width and given length for stabilizing a watercraft during boarding and exiting of said watercraft comprising:

a) a pair of spaced pontoons having above-water surface areas, below-water surface areas, inner sides, and lengths equal to from about 0.25 to about 1.0 times the given length of said watercraft; and b) horizontal supports having lengths approximately equal to the given width of said watercraft joining said pontoons in a spaced, parallel relationship, said pontoons being transverse to the longitudinal axes of said pontoons and having opposed outer ends attached to said pontoons, whereby said supports are below the water level when said apparatus is in the water; and c) watercraft support saddles including rollers mounted on said supports.

12. The apparatus of claim 11, wherein said pontoons have non-skid upper surfaces.

13. The apparatus of claim 11, wherein said watercraft is a kayak or a canoe.

14. The apparatus of claim 11, further including a watercraft securing strap.

15. The apparatus of claim 11, further including wheels.

16. The apparatus of claim 11, further including a handrail.

17. The apparatus of claim 11, wherein the above-water surface area of each pontoon is approximately equal to the below-water surface of the pontoon.

18. The apparatus of claim 11, wherein the inner sides of said pontoons are attached at a distance approximately equal to the given width of said watercraft.

19. The apparatus of claim 11, wherein each of said saddles has a horizontal center section and upwardly inclined wings on either side of said center section.

* * * * *